US008728694B2

(12) United States Patent
Uemura et al.

(10) Patent No.: US 8,728,694 B2
(45) Date of Patent: May 20, 2014

(54) ELECTROSTATIC LATENT IMAGE-DEVELOPING TONER AND METHOD FOR FORMING IMAGE

(71) Applicant: Kyocera Document Solutions Inc., Osaka (JP)

(72) Inventors: Hiroki Uemura, Osaka (JP); Yukinori Nakayama, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 13/659,442

(22) Filed: Oct. 24, 2012

(65) Prior Publication Data

US 2013/0101933 A1 Apr. 25, 2013

(30) Foreign Application Priority Data

Oct. 25, 2011 (JP) ..... 2011-233612

(51) Int. Cl.
*G03G 9/08* (2006.01)

(52) U.S. Cl.
USPC ..... 430/108.6; 399/252

(58) Field of Classification Search
USPC ..... 430/108.6; 399/252
See application file for complete search history.

(56) References Cited

U.S. PATENT DOCUMENTS

2003/0186151 A1* 10/2003 Nakayama et al. ..... 430/108.6

FOREIGN PATENT DOCUMENTS

JP 2009-180890 8/2009

* cited by examiner

*Primary Examiner* — Mark A Chapman
(74) *Attorney, Agent, or Firm* — K&L Gates LLP

(57) ABSTRACT

An image is formed with an electrostatic latent image-developing toner that includes toner base particles and titanium oxide serving as an external additive. The toner base particles containing a binder resin, a colorant, and a charge control agent. The titanium oxide is attached to surfaces of the toner base particles and containing titanium oxide A and titanium oxide B. Each of the titanium oxide A and the titanium oxide B has a predetermined particle diameter and a predetermined volume resistivity. The liberation rate of each of the titanium oxide A and the titanium oxide B in the toner is within a predetermined range.

6 Claims, 1 Drawing Sheet

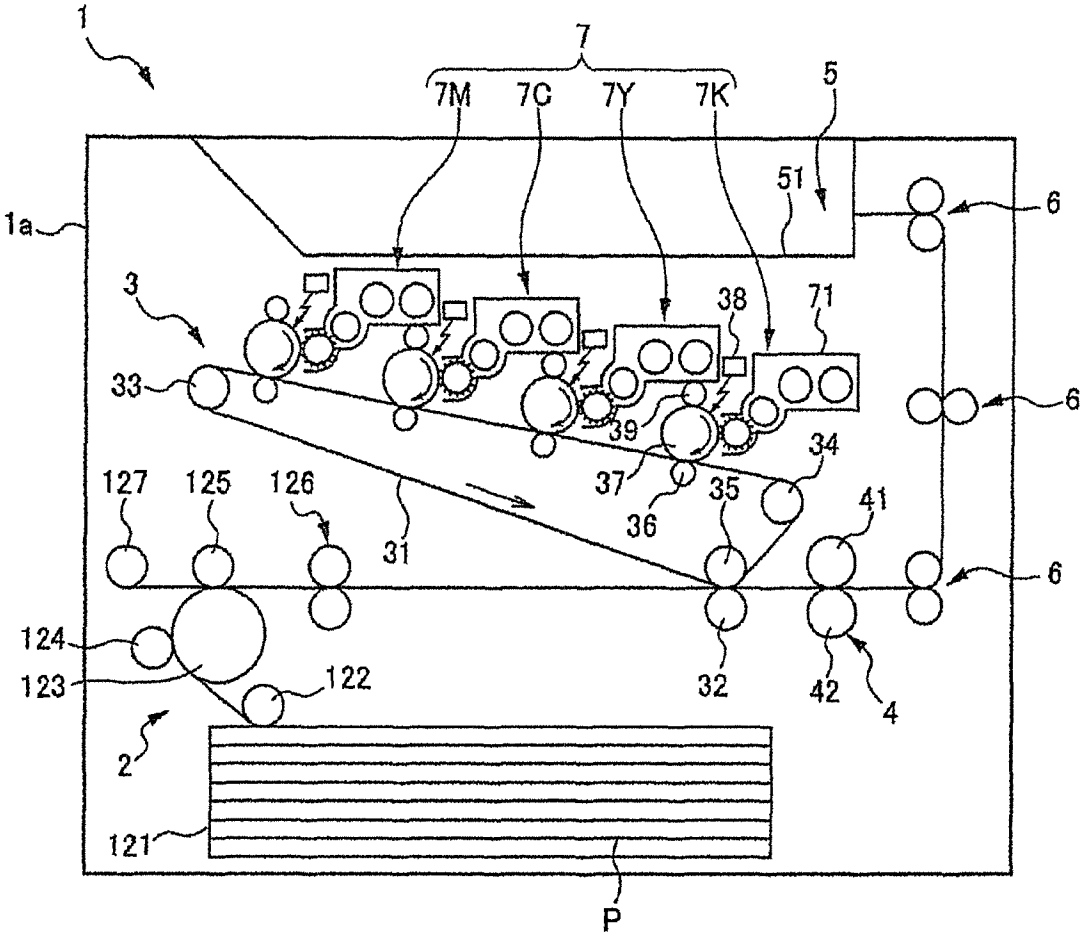
1
1a
3
5
51
6
6
6
7
7K
7Y
7C
7M
71
38
39
37
36
33
34
35
31
32
41
42
4
125
126
127
124
123
122
121
2
P

ELECTROSTATIC LATENT IMAGE-DEVELOPING TONER AND METHOD FOR FORMING IMAGE

INCORPORATION BY REFERENCE

This application is based upon and claims the benefit of priority from the corresponding Japanese Patent application No. 2011-233612, filed Oct. 25, 2011, the entire contents of which are incorporated herein by reference.

FIELD

The present disclosure relates to an electrostatic latent image-developing toner for use in an image-forming apparatus including a latent image-bearing member and a cleaning device having an elastic blade. The latent image-bearing member includes at least a thin photosensitive layer composed of amorphous silicon on a conductive base. In addition, the disclosure relates to a method for forming an image with the image-forming apparatus.

BACKGROUND

In a typical electrophotographic method, a latent image-bearing member formed of a photoconductive photoreceptor is charged by corona charging. The charged latent image-bearing member is exposed with a laser or a light-emitting diode (LED) to form an electrostatic latent image. The electrostatic latent image is subjected to reversal development for visualization, thereby forming a high-quality image.

Typically for this method, the latent image-bearing member includes a photosensitive layer composed of an organic photoconductor (OPC). To improve the durability of an image-forming apparatus, the use of a latent image-bearing member including a photosensitive layer composed of amorphous silicon has recently been studied. The latent image-bearing member is abraded by scraping against a printing medium and an elastic blade described below. However, amorphous silicon has excellent abrasion resistance. Thus, the use of the latent image-bearing member including the photosensitive layer composed of amorphous silicon provides a highly durable image-forming apparatus. Specifically, the rate of thickness reduction of amorphous silicon by abrasion is 1/100 or less of those of organic photoconductors.

Furthermore, in the latent image-bearing member including the photosensitive layer composed of amorphous silicon, a reduction in the thickness of the photosensitive layer has been promoted because of its good productivity and better resolution of an image than that in the case of greater thickness.

After the toner image is transferred to a surface of a printing medium, such as paper, toner left on the surface of the latent image-bearing member including the photosensitive layer composed of amorphous silicon is removed by a cleaning device. As the cleaning device, an elastic blade is widely used because it has a simple structure with a small number of moving parts and contributes to the miniaturization of an image-forming apparatus.

Thus, there have been advances in the use of an image-forming apparatus including a latent image-bearing member in combination with a cleaning device having an elastic blade, the latent image-bearing member having a thin photosensitive layer composed of amorphous silicon.

However, in the situation when the latent image-bearing member including the photosensitive layer composed of amorphous silicon is used and the latent image-bearing member is charged by a charging device, corona products are attached to a surface of the latent image-bearing device. In the situation when an image-forming apparatus including the latent image-bearing member in which the corona products are accumulated on the surface of the latent image-bearing member is used, and an electrostatic latent image is formed in a high-temperature and high-humidity environment, the electrostatic latent image on the surface of the latent image-bearing member may be disturbed. This phenomenon is called an image flow.

To inhibit the occurrence of the image flow, a method is reported in which a toner including an external additive, such as titanium oxide, which has a polishing effect, attached to surfaces of particles of the toner is used, and the toner is pressed against the surface of the latent image-bearing member with the elastic blade to remove corona products on the surface of the latent image-bearing member.

As a toner to inhibit the occurrence of the image flow in the image-forming apparatus including the latent image-bearing member having the photosensitive layer composed of amorphous silicon, a toner including a conductive fine particle as an external additive, such as titanium oxide, externally added to a toner base particle thereof, has been used. The conductive fine particle has an average primary particle diameter of 90 nm or less, an average aggregated particle diameter of 0.5 μm to 2.0 μm, and a BET specific surface area of 15 $m^2/g$ or more.

However, even if the elastic blade is used, toner left on the surface of the latent image-bearing member is not completely removed. For example, toner particles, magnetic powder, resin pieces, and an external additive, such as silica, accumulate on a distal end portion of the elastic blade, the distal end portion being a portion where the elastic blade is pressed against the latent image-bearing member. When the residue accumulated on the surface of the latent image-bearing member near the elastic blade continues to rub against the elastic blade and the photosensitive layer composed of amorphous silicon for a prolonged period, a charge-up phenomenon occurs in which the residue is excessively charged to a level equal to or larger than an allowable amount of charge.

When the charge-up phenomenon occurs, the amount of charge of the residue exceeds the withstand voltage of the photosensitive layer composed of amorphous silicon, electrical discharge (leakage phenomenon) to a submicroscopic region of the surface of the latent image-bearing member is liable to occur. Thus, in the thin photosensitive layer which is composed of amorphous silicon and which has a low dielectric breakdown voltage, the leakage phenomenon is liable to cause dielectric breakdown. As described above, in the image-forming apparatus including the cleaning device having the elastic blade and the latent image-bearing member having the thin photosensitive layer composed of amorphous silicon, the dielectric breakdown of the photosensitive layer may cause an unrecoverable defect on the surface of the latent image-bearing member. In the situation when the dielectric breakdown of the photosensitive layer occurs in the latent image-bearing member, an image defect, called a "black spot", may be caused in a formed image.

In the latent image-bearing member including the thin photosensitive layer composed of amorphous silicon as described above, the supply of a conductive external additive, such as titanium oxide, to the surface of the latent image-bearing member in a state in which the external additive is freed from a toner is effective in inhibiting the occurrence of the dielectric breakdown of the photosensitive layer. The employment of such a method disperses the charge of the residue, thereby inhibiting the occurrence of the leakage phenomenon.

However, even if the foregoing toner is used, although the occurrence of the image flow is inhibited, the degree of inhibition is not sufficient, so further improvement is required. Furthermore, even if the foregoing toner is used, in the situation when images with low coverage rate are formed for a long time and where the toner is stirred in a developing unit for a long time, the image density of the formed images may be lower than a desired value. Moreover, in the situation when the foregoing toner is used, the occurrence of the dielectric breakdown of the latent image-bearing member including the thin photosensitive layer composed of amorphous silicon is not necessarily inhibited. In this regard, further improvement is also required.

SUMMARY

An electrostatic latent image-developing toner according to an aspect of the present disclosure includes: toner base particles containing a binder resin, a colorant, and a charge control agent; and an external additive attached to surfaces of the toner base particles. The external additive contains titanium oxide. The titanium oxide contains titanium oxide A and titanium oxide B. The titanium oxide A has an average primary particle diameter of 50 nm to 180 nm and a volume resistivity of $1\times10^{1}$ Ω·cm to $1\times10^{7}$ Ω·cm. The titanium oxide B has an average primary particle diameter of 200 nm to 500 nm and a volume resistivity of $1\times10^{7}$ Ω·cm to $1\times10^{15}$ Ω·cm. When the liberation rate of the titanium oxide in the electrostatic latent image-developing toner is measured by the classification of free titanium oxide in the electrostatic latent image-developing toner with an air classifier, the liberation rate of the titanium oxide A is 50% by mass or less, and the liberation rate of the titanium oxide B is greater than 50% by mass.

A method for forming an image, according to another aspect of the present disclosure, is provided comprising a method for forming an image with an image-forming apparatus using an electrostatic latent image-developing toner, the image-forming apparatus including a latent image-bearing member and a cleaning device having an elastic blade, the latent image-bearing member including a thin photosensitive layer composed of amorphous silicon on a conductive base, and the distance between a surface of the conductive base adjacent to the photosensitive layer and the uppermost surface of the latent image-bearing member being 30 μm or less. The electrostatic latent image-developing toner includes: toner base particles containing a binder resin, a colorant, and a charge control agent; and an external additive attached to the toner base particles. The external additive contains titanium oxide. The titanium oxide contains titanium oxide A and titanium oxide B. The titanium oxide A has an average primary particle diameter of 50 nm to 180 nm and a volume resistivity of $1\times10^{1}$ Ω·cm to $1\times10^{7}$ Ω·cm. The titanium oxide B has an average primary particle diameter of 200 nm to 500 nm and a volume resistivity of $1\times10^{7}$ Ω·cm to $1\times10^{15}$ Ω·cm. When the liberation rate of the titanium oxide in the electrostatic latent image-developing toner is measured by the classification of free titanium oxide in the electrostatic latent image-developing toner with an air classifier, the liberation rate of the titanium oxide A is 50% by mass or less, and the liberation rate of the titanium oxide B is greater than 50% by mass.

Additional features and advantages are described herein, and will be apparent from the following Detailed Description and the figure.

BRIEF DESCRIPTION OF THE FIGURE

FIG. 1 is a cross-sectional view illustrating the structure of an image-forming apparatus according to an embodiment of the present disclosure.

DETAILED DESCRIPTION

While embodiments of the present disclosure will be described below in detail, the present disclosure is not limited to the embodiments described below. Appropriate modifications may be made within the scope of the objects of the present disclosure. While redundant descriptions may not be made, the gist of the present disclosure is not limited thereto.

First Embodiment

In an embodiment, the present disclosure relates to an electrostatic latent image-developing toner (hereinafter, also referred to simply as a "toner"). The electrostatic latent image-developing toner according to the embodiment is used for an image-forming apparatus including a latent image-bearing member and a cleaning device having an elastic blade, the latent image-bearing member including at least a thin photosensitive layer composed of amorphous silicon on a conductive base.

When the image-forming apparatus having the foregoing structure is used in a high temperature and high humidity environment, an image flow of an electrostatic latent image formed on the latent image-bearing member may be easily made. However, the use of the toner of the present disclosure as a toner for use in the image-forming apparatus having the foregoing structure successfully inhibits the occurrence of the image flow.

The electrostatic latent image-developing toner of the present disclosure includes toner base particles each containing at least: a binder resin, a colorant, and a charge control agent; and an external additive adhering to surfaces of the toner base particles. The external additive contains titanium oxide. The titanium oxide contains titanium oxide A and the titanium oxide B. The titanium oxide A has an average primary particle diameter of 50 nm to 180 nm and a volume resistivity of $1\times10^{1}$ Ω·cm to $1\times10^{7}$ Ω·cm. The titanium oxide B has an average primary particle diameter of 200 nm to 500 nm and a volume resistivity of $1\times10^{7}$ Ω·cm to $1\times10^{15}$ Ω·cm. The liberation rate of titanium oxide in the electrostatic latent image-developing toner is measured by the classification of free titanium oxide in the electrostatic latent image-developing toner. The liberation rate of the titanium oxide A is 50% by mass or less. The liberation rate of the titanium oxide B is greater than 50% by mass. The toner of the present disclosure may contain a release agent, a magnetic powder, and so forth in the binder resin, as needed. Furthermore, the toner of the present disclosure may be mixed with a carrier to form a mixture that may be used as a two-component developer, if desired.

With respect to the electrostatic latent image-developing toner of the present disclosure, the binder resin, the colorant, the charge control agent, the release agent, the magnetic powder, a method for producing the toner base particles, the external additive, external addition treatment, and the carrier for use in the two-component developer will be described below in sequence.

Binder Resin

Any resin that has been used as a binder resin for toner may be used as the binder resin contained in the toner base particles. Specific examples of the binder resin include thermoplastic resins, such as styrene resins, acrylic resins, styrene-acrylic resins, polyethylene resins, polypropylene resins, vinyl chloride resins, polyester resins, polyamide resins, polyurethane resins, polyvinyl alcohol resins, vinyl ether resins, N-vinyl resins, and styrene-butadiene resins. Among these resins, styrene-acrylic resins and polyester resins are preferred in view of the dispersion properties of the colorant in the toner, the chargeability of the toner, and the fixability of the toner on a sheet. Styrene-acrylic resins and polyester resins will be described below.

Styrene-acrylic resins are copolymers of styrene monomers and acrylic monomers. Specific examples of styrene monomers include styrene, α-methylstyrene, vinyltoluene, α-chlorostyrene, o-chlorostyrene, m-chlorostyrene, p-chlorostyrene, and p-ethylstyrene. Specific examples of acrylic monomers include alkyl (meth)acrylates, such as methyl acrylate, ethyl acrylate, n-propyl acrylate, isopropyl acrylate, n-butyl acrylate, isobutyl acrylate, 2-ethylhexyl acrylate, methyl methacrylate, ethyl methacrylate, n-butyl methacrylate, and isobutyl methacrylate.

Polyester resins prepared by polycondensation or copolycondensation of alcohol components and carboxylic acid components may be used. Examples of components used to prepare polyester resins include dihydric or tri- or higher-hydric alcohol components and divalent or tri- or higher-valent carboxylic acid components.

Specific examples of the dihydric or tri- or higher-hydric alcohol components include diols, such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol; bisphenols, such as bisphenol A, hydrogenated bisphenol A, polyoxyethylenated bisphenol, and polyoxypropylenated bisphenol A; and tri- or higher-hydric alcohols, such as sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Specific examples of the divalent or tri- or higher-valent carboxylic acid components include divalent carboxylic acids, such as maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, and alkyl- and alkenyl-succinic acids, such as n-butylsuccinic acid, n-butenylsuccinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid, and isododecenylsuccinic acid; and tri- or higher-valent carboxylic acids, such as 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and enpole timer acid. These divalent or tri- or higher-valent carboxylic acid components may be used in the form of ester-forming derivatives, such as acid halides, acid anhydrides, and lower alkyl esters. The term "lower alkyl" used here refers to alkyl groups each having 1 to 6 carbon atoms.

In the case where the binder resin is a polyester resin, the polyester resin preferably has a softening point of 80° C. to 150° C. and more preferably 90° C. to 140° C.

A thermoplastic resin is preferably used as the binder resin because of its satisfactory fixability. The thermoplastic resin may be used alone as the binder resin. Alternatively, a mixture of the thermoplastic resin, a cross-linking agent, and/or a thermosetting resin may be used as the binder resin. The introduction of a partially cross-linked structure into the binder resin improves the storage stability, the shape retention, and the durability of the toner without reducing the fixability of the toner.

Preferred examples of the thermosetting resin that may be used together with the thermoplastic resin include epoxy resins and cyanate resins. Specific examples of the preferred thermosetting resins include bisphenol A-type epoxy resins, hydrogenated bisphenol A-type epoxy resins, novolac-type epoxy resins, polyalkylene ether-type epoxy resins, alicyclic epoxy resins, and cyanate resins. These thermoplastic resins may be used in combination.

The binder resin preferably has a glass transition point of (Tg) of 50° C. to 65° C. and more preferably 50° C. to 60° C. An excessively low glass transition point of the binder resin may cause the fusion of particles of the toner in a developing device of an image-forming apparatus and the partial fusion of the toner particles due to a reduction in the storage stability of the toner during the transportation of a toner container and during the storage of the toner container in, for example, a warehouse. An excessively high glass transition point may cause a reduction in the strength of the binder resin, thereby attaching the toner to the latent image-bearing member. Furthermore, an excessively high glass transition point may cause a reduction in the low-temperature fixability of the toner.

The glass transition point of the binder resin may be measured with a differential scanning calorimeter (DSC) and determined from the point at which the specific heat of the binder resin is changed. A differential scanning calorimeter (model: DSC-6200, manufactured by Seiko Instruments Inc.) is used as a measuring apparatus. The glass transition point of the binder resin may be determined by measuring the endothermic curve of the binder resin. More specifically, 10 mg of a measurement sample is placed in an aluminum pan, and an empty aluminum pan is used as a reference. The glass transition point of the binder resin may be determined from the endothermic curve of the binder resin measured in the measurement temperature range of 25° C. to 200° C. at a rate of temperature increase of 10° C./min under room-temperature and normal-humidity conditions.

Colorant

As the colorant contained in the electrostatic latent image-developing toner of the present disclosure, a known pigment or dye may be used in response to the color of the toner particles. Specific examples of the colorant that may be added to the toner include black pigments, such as carbon black, acetylene black, lamp black, and aniline black; yellow pigments, such as chrome yellow, zinc yellow, cadmium yellow, yellow iron oxide, mineral fast yellow, nickel titanium yellow, Naples yellow, naphthol yellow S, Hansa yellow G, Hansa yellow 10G, benzidine yellow G, benzidine yellow GR, quinoline yellow lake, permanent yellow NCG, and tartrazine lake; orange pigments, such as chrome orange, molybdenum orange, permanent orange GTR, pyrazolone orange, Vulcan orange, and indanthrene brilliant orange GK; red pigments, such as colcothar, cadmium red, red lead, cadmium mercury sulfide, permanent red 4R, lithol red, pyrazolone red, watching red calcium salt, lake red D, brilliant carmine 6B, eosine lake, rhodamine lake B, alizarin lake, and brilliant carmine 3B; violet pigments, such as manganese purple, fast violet B, and methyl violet lake; blue pigments, such as Prussian blue, cobalt blue, alkali blue lake, partially chlorinated victoria blue, fast sky blue, and indanthrene blue BC; green pigments, such as chromium green, chromium oxide, pigment green B, malachite green lake, and final yellow green G; white pigments, such as zinc white, titanium oxide, antimony white, and zinc sulfide; and extender pigments, such as a barite powder, barium carbonate, clay, silica, white carbon, talc, and alumina white. These colorants may be used in combination in order to, for example, adjust the toner in such a manner that the toner has a desired hue.

The amount of the colorant used is not particularly limited. Specifically, the amount of the colorant used is preferably in the range of 1 to 10 parts by mass and more preferably 3 to 7 parts by mass with respect to 100 parts by mass of the binder resin.

Charge Control Agent

The electrostatic latent image-developing toner of the present disclosure contains the charge control agent in the binder resin. The charge control agent is used to provide the toner having excellent durability and stability by improving the charge level of the toner and the charge rise characteristics serving as an index as to whether the toner can be charged to a predetermined level in a short time or not. In the case where the toner is positively charged to perform developing, a positively chargeable charge control agent is used. In the case where the toner is negatively charged to perform developing, a negatively chargeable charge control agent is used.

The charge control agent is not particularly limited, and may be selected from charge control agents that have been used for toners in the past. Specific examples of the positively chargeable charge control agent include azine compounds, such as pyridazine, pyrimidine, pyrazine, orthoxazine, methoxazine, paraoxiazine, orthothiazine, meththiazine, parathiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes composed of azine compounds, such as azine fast red FC, azine fast red 12BK, azine violet BO, azine brown 3G, azine light brown GR, azine dark green BH/C, azine deep black EW, and azine deep black 3RL; nigrosine compounds, such as nigrosine, nigrosine salts, and nigrosine derivatives; acid dyes composed of nigrosine compounds, such as nigrosine BK, nigrosine NB, and nigrosine Z; metal salts of naphthenic acid and higher fatty acids; alkoxylated amines; alkylamides; and quaternary ammonium salts, such as benzylmethylhexyldecylammonium chloride and decyltrimethylammonium chloride. Among these positively chargeable charge control agents, nigrosine compounds are particularly preferred from the viewpoint of achieving better charge rise characteristics. These positively chargeable charge control agents may be used in combination.

A resin containing a quaternary ammonium salt, a carboxylate, and a carboxy group as a functional group may be used as the positively chargeable charge control agent. Specific examples thereof include quaternary ammonium salt-containing styrene resins, quaternary ammonium salt-containing acrylic resins, quaternary ammonium salt-containing styrene-acrylic resins, quaternary ammonium salt-containing polyester resins, carboxylate-containing styrene resins, carboxylate-containing acrylic resins, carboxylate-containing styrene-acrylic resins, carboxylate-containing polyester resins, carboxy group-containing styrene resins, carboxy group-containing acrylic resins, carboxy group-containing styrene-acrylic resins, and carboxy group-containing polyester resins. The molecular weight of each of the resins is not particularly limited and these resins may be oligomers or polymers.

Among the resins that may be used as the positively chargeable charge control agents, styrene-acrylic resins containing quaternary ammonium salts as functional groups are more preferred from the viewpoint of easily adjusting the amount of charge of the toner to a desired range. With respect to a styrene-acrylic resin containing a quaternary ammonium salt as a functional groups, specific examples of an acrylic comonomer to be copolymerized with a styrene unit include alkyl (meth)acrylates, such as methyl acrylate, ethyl acrylate, n-propyl acrylate, isopropyl acrylate, n-butyl acrylate, isobutyl acrylate, 2-ethylhexyl acrylate, methyl methacrylate, ethyl methacrylate, n-butyl methacrylate, and isobutyl methacrylate.

A unit derived from dialkylaminoalkyl (meth)acrylate, dialkyl(meth)acrylamide, or dialkylaminoalkyl(meth)acrylamide through a quaternization step is used as the quaternary ammonium salt. Specific examples of dialkylaminoalkyl (meth)acrylate include dimethylaminoethyl (meth)acrylate, diethylaminoethyl (meth)acrylate, dipropylaminoethyl (meth)acrylate, and dibutylaminoethyl (meth)acrylate. A specific example of dialkyl(meth)acrylamide is dimethylmethacrylamide. A specific example of dialkylaminoalkyl (meth)acrylamide is dimethylaminopropylmethacrylamide. A hydroxy group-containing polymerizable monomer, such as hydroxyethyl (meth)acrylate, hydroxypropyl (meth)acrylate, 2-hydroxybutyl (meth)acrylate, or N-methylol(meth) acrylamide may also be used during polymerization.

Specific examples of the negatively chargeable charge control agent include organometallic complexes and chelate compounds. As the organometallic complexes and chelate compounds, metal acetylacetonate complexes, such as aluminum acetylacetonate and iron(II) acetylacetonate, salicylic acid metal complexes, such as chromium 3,5-di-tert-butylsalicylate, and salicylic acid metal salts are preferred. Salicylic acid metal complexes and salicylic acid metal salts are more preferred. These negatively chargeable charge control agent may be used in combination.

The amount of the positively or negatively chargeable charge control agent used is not particularly limited. The amount of the positively or negatively chargeable charge control agent used is preferably 1.5 to 15 parts by mass, more preferably 2.0 to 8.0 parts by mass, and particularly preferably 3.0 to 7.0 parts by mass with respect to 100 parts by mass of the total amount of the toner. In the case of an excessively small amount of the charge control agent used, it is difficult to stably charge the toner to a predetermined polarity. Thus, the image density of a formed image may be less than a desired value, and it may be difficult to maintain the image density of the formed image over a prolonged period. In the case of an excessively small amount of the charge control agent used, it is difficult to uniformly disperse the charge control agent in the toner. Thus, fogging occurs easily in the formed image, and the latent image-bearing member is easily contaminated with the toner components. In the case of an excessively large amount of the charge control agent used, under high-temperature and high-humidity conditions, an image defect in the formed image is easily formed because of insufficient charging of the toner under high-temperature and high-humidity conditions due to a reduction in the environmental resistance of the toner, and the latent image-bearing member is easily contaminated with the toner component, for example.

Release Agent

The electrostatic latent image-developing toner of the present disclosure may contain the release agent in order to improve the fixability and the offset resistance of the toner.

The release agent that may be added to the toner is not particularly limited. A wax is preferred as the release agent. Examples of the wax include polyethylene wax, polypropylene wax, fluorocarbon resin wax, Fischer-Tropsch wax, paraffin wax, ester wax, montan wax, and rice wax. These release agents may be used in combination. The incorporation of the release agent into the toner more efficiently inhibits the occurrence of an offset and image smearing (a smear around an image when the image is rubbed).

The amount of the release agent used is not particularly limited. Specifically, the amount of the release agent used is preferably 1 to 5 parts by mass with respect to 100 parts by mass of the binder resin. When the amount of the release agent used is excessively small, desired effects of inhibiting the occurrence of an offset and image smearing are not provided, in some cases. When the amount of the release agent used is excessively large, the storage stability of the toner may be reduced by the fusion of toner particles.

Magnetic Powder

The electrostatic latent image-developing toner of the present disclosure may contain a magnetic powder in the binder resin, if desired. The magnetic powder that may be added to the toner is not particularly limited. Specific examples of the magnetic powder include iron oxides, such as ferrite and magnetite; ferromagnetic metals, such as cobalt and nickel; alloys containing iron and/or ferromagnetic metals; compounds containing iron and/or ferromagnetic metals; ferromagnetic alloys subjected to ferromagnetization treatment, such as heat treatment; and chromium dioxide.

The particle diameter of the magnetic powder is not particularly limited. The magnetic powder preferably has a particle diameter of 0.1 μm to 1.0 μm and more preferably 0.1 μm to 0.5 μm. The use of the magnetic powder having the particle diameter range described above easily allows the magnetic powder to be uniformly dispersed in the binder resin.

To improve the dispersibility of a magnetic powder in the binder resin, the magnetic powder surface-treated with a surface treatment agent, such as a titanium coupling agent or a silane coupling agent, may be used as the magnetic powder.

The amount of the magnetic powder used is not particularly limited. Specifically, when the toner is used as a one-component developer, the amount of the magnetic powder used is preferably 35 to 60 parts by mass and more preferably 40 to 60 parts by mass with respect to 100 parts by mass of the total amount of the toner. In the case of an excessively large amount of the magnetic powder used, the image density of a formed image may be less than a desired value when printing is performed over a prolonged period, and the fixability may be significantly reduced. In the case of an excessively small amount of the magnetic powder used, fogging may occur easily in a formed image, and the image density of the formed image may be less than a desired value when printing is performed over a prolonged period. When the toner is used as a two-component developer, the amount of the magnetic powder used is preferably 20 parts by mass or less and more preferably 15 parts by mass or less with respect to 100 parts by mass of the total amount of the toner.

Method for Producing Toner Base Particles

The toner base particles of the electrostatic latent image-developing toner of the present disclosure is produced by adding the colorant, the charge control agent, and optionally any components, for example, the release agent and/or the magnetic powder, to the binder resin, melt-kneading the resulting mixture to provide a melt-kneaded mixture, and adjusting the particle diameter of the pulverized mixture to a desired value by pulverizing and classifying the melt-kneaded mixture.

A method for producing the toner base particles by adding the colorant, the release agent, the charge control agent, the magnetic powder, and so forth to the binder resin is not particularly limited as long as these components can be satisfactorily dispersed in the binder resin. An example of the method for producing the toner base particles is a method in which after the binder resin is mixed with the colorant, the release agent, the charge control agent, the magnetic powder, and so forth with, for example, a mixer, the binder resin and the components incorporated into the binder resin are melt-kneaded with, for example, a single- or twin-screw extruder, and the resulting kneaded mixture is cooled, pulverized, and classified. The average particle diameter of the toner base particles is not particularly limited as long as the object of the present disclosure is not impaired. In general, the base toner particles preferably have a particle diameter of 5 μm to 10 μm.

External Additive

The electrostatic latent image-developing toner of the present disclosure is a toner in which an external additive adheres to surfaces of the toner base particles. The external additive contains titanium oxide A and titanium oxide B each having an average primary particle diameter in a predetermined range and a predetermined volume resistivity in a predetermined range. The titanium oxide A has an average primary particle diameter of 50 nm to 180 nm and a volume resistivity of $1\times10^{1}$ Ω·cm to $1\times10^{7}$ Ω·cm. The titanium oxide B has an average primary particle diameter of 200 nm to 500 nm and a volume resistivity of $1\times10^{7}$ Ω·cm to $1\times10^{15}$ Ω·cm. With respect to the titanium oxide contained in the external additive, the particle diameter, the volume resistivity, the liberation rate, and the amount used will be described below in sequence.

Particle Diameter

The titanium oxide A contained in the external additive has an average primary particle diameter of 50 nm to 180 nm. The titanium oxide B has an average primary particle diameter of 200 nm to 500 nm. In the case of the titanium oxide A having an excessively small average primary particle diameter, the image density of a formed image is liable to be less than a desired value when printing is performed over a prolonged period. In the case of the titanium oxide A having an excessively large average primary particle diameter, the image density of a formed image is liable to be less than a desired value when printing is performed over a prolonged period.

In the case of the titanium oxide B having an excessively small average primary particle diameter, the surface of the latent image-bearing member may be not sufficiently polished. Thus, an image flow of an electrostatic latent image formed on the surface of the latent image-bearing member may occur easily in a high-temperature and high-humidity environment. In the case of the titanium oxide B having an excessively large average primary particle diameter, the image density of a formed image is liable to be less than a desired value when printing is performed over a prolonged period. Furthermore, the service life of the latent image-bearing member may be less than expected.

As the titanium oxide A and the titanium oxide B having such average primary particle diameters, commercially available titanium oxide products may be used. Furthermore, titanium oxide produced by grinding titanium oxide having an average primary particle diameter exceeding 500 nm by a known pulverizing process, such as a wet-pulverizing process with a sand mill, so as to have a desired average primary particle diameter may be used. The average primary particle diameter of titanium oxide may be measured with a laser diffraction particle size distribution analyzer.

Volume Resistivity

The titanium oxide A having a volume resistivity of less than $1\times10^{1}$ Ω·cm may fail to impart sufficient positive chargeability to the toner, so that the image density of a formed image is liable to be less than a desired value. The titanium oxide A having a volume resistivity exceeding $1\times10^{7}$ Ω·cm is liable to lead to an excessive increase in the amount of charge of the toner. Hence, the image density of a formed image may be reduced with time and thus is liable to be less than a desired value. In this case, the amount of charge of the toner components is liable to be excessively large at a portion where the surface of the latent image-bearing member is in contact with the elastic blade. Thus, the dielectric breakdown of the latent image-bearing member may occur, so that an image defect, such as a black spot, may occur easily in the formed image.

The titanium oxide B having a volume resistivity of less than $1\times10^{7}$ Ω·cm may fail to impart sufficient positive chargeability to the toner, so that the image density of a formed image is liable to be less than a desired value. The titanium oxide B having a volume resistivity exceeding $1\times10^{15}$ Ω·cm is liable to cause an excessive increase in the amount of charge of the toner. Hence, the image density of the formed image may be reduced with time and thus is liable to be less than a desired value. In this case, the amount of charge of the toner is liable to be excessively large at a portion where the surface of the latent image-bearing member is in contact with the elastic blade. Thus, the dielectric breakdown of the latent image-bearing member may occur, so that an image defect, such as a black spot, may occur easily in the formed image.

The volume resistivity of each of the titanium oxide A and the titanium oxide B is adjusted as follows: For example, coating layers composed of tin oxide and antimony oxide are formed on surfaces of particles of the titanium oxide. A change in the thickness of the coating layers and a change in the proportion of tin oxide to the antimony oxide adjust the volume resistivity.

A method for measuring the volume resistivity of titanium oxide will be described below. The volume resistivity of each of the titanium oxide A and the titanium oxide B may be measured by a measurement method that has been employed in the past. For example, the measurement may be performed by applying a voltage of 10 V DC to a sample under a load of 1 kg with an ultra-high resistance meter (model: R8340A, manufactured by Advantest Corporation).

Liberation Rate

The liberation rate of the titanium oxide A in the electrostatic latent image-developing toner is 50% by mass or less. The liberation rate of the titanium oxide B in the electrostatic latent image-developing toner is greater than 50% by mass. In the case of a liberation rate of the titanium oxide A is greater than 50% by mass, when the toner is used for a prolonged period, the image density of a formed image may be reduced with time and thus is liable to be less than a desired value. The titanium oxide B has a large average primary particle diameter and thus has a high ability to polish the surface of the latent image-bearing member. A liberation rate of the titanium oxide B of 50% by mass or less is less likely to lead to sufficient polishing of the surface of the latent image-bearing member. In this case, corona products on the surface of the latent image-bearing member may not be readily removed, so that an image flow of an electrostatic latent image formed on the surface of the latent image-bearing member may be easily caused in a high-temperature and high-humidity environment.

A method for measuring the liberation rate of titanium oxide in the electrostatic latent image-developing toner of the present disclosure will be described below.

The liberation rates of the titanium oxide A and the titanium oxide B in the present disclosure are measured by, for example, classifying the titanium oxide A and the titanium oxide B from the toner with an air classifier (DSX-2, manufactured by Nippon Pneumatic Mfg. Co., Ltd.) under conditions described below.

Separation Conditions of Titanium Oxide

Sample feed rate: 100 g/min

Injection pressure at feed section: 0.2 MPa

Adjusting ring: 80 mm

Louver height: 10 mm

Louver clearance: 5 mm

Distance ring: 0 mm

Center navel: 60 mm

U damper: 45°

Cyclone damper: 30°

Total static pressure of blower: −800 mmAq (−7.85 kPa)

The method for measuring the liberation rate of titanium oxide will be described below in detail. With respect to free titanium oxide separated from the toner containing free titanium oxide A and free titanium oxide B, the particle diameter, the number of particles, and the average volume are measured with a measuring device using laser diffraction. In this case, the number distribution curve of the free titanium oxide for each particle diameter has a shape in which bottoms of two peaks overlap with each other because the free titanium oxide contains two types of free titanium oxide originating from the titanium oxide A and the titanium oxide B that have different particle diameter distributions. The particle diameter distribution curve having the shape in which the bottoms of the two peaks overlap with each other is separated into a particle diameter distribution curve of the free titanium oxide originating from the titanium oxide A and a particle diameter distribution curve of the free titanium oxide originating from the titanium oxide B by the analysis of the waveform of the graph of the particle diameter distribution with waveform analysis software. The number of particles and the average volume of each of the free titanium oxide originating from the titanium oxide A and the free titanium oxide originating from the titanium oxide B are determined on the basis of the separated two particle diameter distribution curves.

The resulting liberation rate of the titanium oxide A or the titanium oxide B is calculated from the expression described below with the number of particles and the average volume of the free titanium oxide originating from the titanium oxide A or the titanium oxide B and the amount of the titanium oxide A or the titanium oxide B in the toner.

As the waveform analysis software, Origin 8.5 (manufactured by Lightstone Corp.) may be used. As the measuring device using laser diffraction, LA-950 (manufactured by HORIBA, Ltd.) may be used.

Calculation Formula for Liberation Rate of Titanium Oxide (Average volume of free titanium oxide ($cm^3$)×number of particles of free titanium oxide×density of titanium oxide ($g/cm^3$))/amount of titanium oxide added (g))×100

In the case where the amount of the titanium oxide A or the titanium oxide B used in the preparation of the toner is known, a value calculated on the basis of the known amount may be used as the amount of the titanium oxide A or the titanium oxide B in the toner.

In the case where the amount of the titanium oxide A or the titanium oxide B in the toner is unknown, the amount of the titanium oxide A or the titanium oxide B in the toner may be measured by a method described below.

First, the toner is completely burned in air. At this time, a temperature at which the external additives, such as the titanium oxide A and the titanium oxide B, are not melted and at which the toner is sufficiently burned is preferred as the combustion temperature. Residues from the combustion are dispersed in an appropriate solvent, such as water, to prepare a sample. The sample is subjected to centrifugation with a centrifugal separator to collect the titanium oxide A and the titanium oxide B separated by the difference in specific gravity. With respect to the titanium oxide A and the titanium oxide B recovered after the titanium oxide A and the titanium oxide B adhering to the surfaces of the toner particles are detached from the toner base particles, the particle diameter distribution is measured with the laser diffraction-type measuring device, in the same ways as described above. Next, the average volume and the number of particles of each of the titanium oxide A and the titanium oxide B are determined from the resulting particle diameter distribution curves of the titanium oxide A and the titanium oxide B. The product of the average volume ($cm^3$), the number of particles, and the density of titanium oxide ($g/cm^3$) results in the amounts of the titanium oxide A and the titanium oxide B contained in the toner.

In the case where silica is used as an external additive in addition to titanium oxide, substantially no silica is liberated from the surfaces of the toner base particles. Thus, the effect of silica is negligible in the measurement of the liberation rate of titanium oxide.

Amount Used

The amount of titanium oxide used is not limited, provided that, in the electrostatic latent image-developing toner, the liberation rate of the titanium oxide A is 50% by mass or less, the liberation rate of the titanium oxide B is greater than 50% by mass. Typically, the amount of titanium oxide used, which is the total amount of the titanium oxide A and the titanium oxide B used, is preferably 0.5% to 5% by mass and more preferably 1% to 4% by mass with respect to the mass of the electrostatic latent image-developing toner.

An excessively small amount of titanium oxide used is liable to cause the surface of the latent image-bearing member to be insufficiently polished, so that it is difficult to inhibit the occurrence of an image flow of an electrostatic latent image formed on the surface of the latent image-bearing member in a high-temperature and high-humidity environment. An excessively large amount of titanium oxide used is liable to cause a reduction in the flowability of the toner.

The amount of each of the titanium oxide A and the titanium oxide B is preferably 0.1% to 3% by mass and more preferably 0.5% to 2% by mass with respect to the mass of the electrostatic latent image-developing toner. An excessively small amount of the titanium oxide A used is liable to lead to an excessively large amount of charge of the toner at a portion where the surface of the latent image-bearing member is in contact with the elastic blade, thereby easily causing the dielectric breakdown of the latent image-bearing member. An excessively large amount of the titanium oxide A used is liable to lead to an excessively large amount of charge of the toner. Hence, the image density of a formed image may be reduced with time and thus is liable to be less than a desired value. In the case of an excessively small amount of the titanium oxide B used, corona products on the surface of the latent image-bearing member may be not readily removed, thereby easily causing the image flow. An excessively large amount of the titanium oxide B used may cause the excessive abrasion of the surface of the latent image-bearing member, thereby reducing the service life of the latent image-bearing device.

To improve the flowability and the storage stability of the toner, silica is preferably used as an external additive in addition to titanium oxide.

The amount of silica added is not particularly limited. Typically, the amount of silica added is preferably 0.1 to 10 parts by mass and more preferably 0.2 to 5 parts by mass with respect to 100 parts by mass of the toner. The use of silica within the foregoing range easily provides a toner having excellent flowability, storage stability, and cleaning properties.

The silica preferably has an average primary particle diameter of 10 nm to 100 nm and more preferably 12 nm to 80 nm because the silica is effective in improving the flowability and the storage stability of the toner. Primary particles of silica are easily aggregated to form primary aggregates. Particle diameter of the primary silica aggregates are different from those of the particles of free titanium oxide. Thus, the primary silica aggregates are not separated from the toner during the classification operation in measuring the liberation rate of titanium oxide and thus do not affect the measurements of the liberation rate of titanium oxide.

External Addition Treatment

The external additive is attached to the surfaces of the toner base particles to provide the electrostatic latent image-developing toner of the present disclosure. A method for attaching the external additive to the surfaces of the toner base particles is not particularly limited and may be selected from known methods. Specifically, a treatment for attaching the external additive to the toner base particles is performed with a mixer, e.g., a Henschel mixer or Nauta mixer, under treatment conditions such that particles of the external additive are not embedded in the toner base particles.

The liberation rate of the titanium oxide A in the electrostatic latent image-developing toner is 50% by mass or less. The liberation rate of the titanium oxide B in the electrostatic latent image-developing toner is greater than 50% by mass. The liberation rate of each of the titanium oxide A and the titanium oxide B may be adjusted by adjusting the conditions of the external addition treatment. For example, the liberation rate may be reduced by increasing the number of revolutions of the stirring device of the mixer, e.g., a Henschel mixer or Nauta mixer, or increasing the treatment time. Furthermore, the liberation rate may be reduced by increasing the inner temperature of the mixer to allow the external additive to be easily attached to the toner base particles.

Carrier

The electrostatic latent image-developing toner may be mixed with a carrier and used as a two-component developer. In the case of preparing the two-component developer, a magnetic carrier is preferably used.

In the case that the electrostatic latent image-developing toner of the present disclosure is used for preparing a two-component developer, an example of a suitable carrier is a carrier having a carrier core covered with a resin. Specific examples of the carrier core include particles, such as iron, iron subjected to oxidation treatment, reduced iron, magnetite, copper, silicon steel, ferrite, nickel, and cobalt, and particles of alloys of these materials and metals, such as manganese, zinc, and aluminum; particles of alloys, such as iron-nickel alloys and iron-cobalt alloys; particles of ceramic materials, such as titanium oxide, aluminum oxide, copper oxide, magnesium oxide, lead oxide, zirconium oxide, silicon carbide, magnesium titanate, barium titanate, lithium titanate, lead titanate, lead zirconate, and lithium niobate; particles of high-dielectric-constant materials, such as ammonium dihydrogenphosphate, potassium dihydrogenphosphate, and Rochelle salt; and resin carriers in which the foregoing magnetic particles are dispersed in resins.

Specific examples of the resin with which the carrier core is covered include (meth)acrylic polymers, styrene polymers, styrene-(meth)acrylic copolymers, olefin polymers (e.g., polyethylene, chlorinated polyethylene, and polypropylene), polyvinyl chloride, polyvinyl acetate, polycarbonate, cellulose resins, polyester resins, unsaturated polyester resins, polyamide resins, polyurethane resins, epoxy resins, silicone resins, fluorocarbon resins (e.g., polytetrafluoroethylene, polychlorotrifluoroethylene, and polyvinylidene fluoride), phenolic resins, xylene resins, diallylphthalate resins, polyacetal resins, and amino resins. These resins may be used in combination.

The particle diameter of the carrier is not particularly limited. The carrier preferably has a particle diameter of 20 μm to 120 μm and more preferably 25 μm to 80 μm, the particle diameter being measured with an electron microscope.

The apparent density of the carrier is not particularly limited. The apparent density varies depending on the composition and the surface structure of the carrier. Typically, the carrier preferably has an apparent density of 2000 $kg/m^3$ to 2500 $kg/m^3$.

In the case where the electrostatic latent image-developing toner is used for preparing a two-component developer, the toner content is preferably 3% to 20% by mass and more preferably 5% to 15% by mass with respect to the mass of the two-component developer. In the case where the toner content of the two-component developer falls within the foregoing range, appropriate image density is maintained. Furthermore the inhibition of the scattering of the toner results in the inhibition of the contamination of the inside of the image-forming apparatus with toner and the inhibition of the attachment of the toner to, for example, transfer paper.

In another embodiment of the present disclosure, a method for forming an image using the electrostatic latent image-developing toner according to the previous embodiment with the image-forming apparatus including the latent image-bearing member and the cleaning device having the elastic blade. The latent image-bearing member includes at least a thin photosensitive layer composed of amorphous silicon on the conductive base. In the latent image-bearing member, the distance between a surface of the conductive base adjacent to the photosensitive layer and the uppermost surface of the latent image-bearing member is 30 μm or less. The method for forming an image according to the present embodiment will be described below.

The image-forming apparatus used in the method for forming an image according to the present embodiment is not particularly limited as long as the image-forming apparatus includes the latent image-bearing member and the cleaning device having the elastic blade, the latent image-bearing member including at least the thin photosensitive layer composed of amorphous silicon on the conductive base. A preferable example thereof is a tandem-type color image-forming apparatus using a plurality of color toners as described below. Here, a method for forming an image with the tandem-type color image-forming apparatus will be described.

The following tandem-type color image-forming apparatus includes a plurality of latent image-bearing members juxtaposed to each other in a predetermined direction; and a plurality of developing devices. Toner images are formed on surfaces of the respective latent image-bearing members using toners of different colors. Each of the developing devices includes a roller (developing sleeve) configured to transfer the toner attached on a surface thereof and feed the toner onto the surface of a corresponding one of the latent image-bearing members. In each of the developing devices, the electrostatic latent image-developing toner of the present disclosure is fed to a corresponding one of the latent image-bearing members.

FIG. 1 is a schematic view illustrating the structure of the image-forming apparatus used in the method for forming an image according to the present embodiment. Here, a color printer 1 is exemplified as the image-forming apparatus.

As illustrated in FIG. 1, the color printer 1 includes a box-shaped main body 1*a*. The main body 1*a* is provided with a paper feed section 2 configured to feed paper P, an image-forming section 3, and a fixing section 4. The image-forming section 3 is configured to transfer a toner image on the paper P on the basis of, for example, image data while the image-forming section 3 conveys the paper P fed from the paper feed section 2. The fixing section 4 is configured to perform fusing treatment in which the unfixed toner image transferred on the paper P in the image-forming section 3 is fixed on the paper P. Furthermore, a paper-ejecting section 5 to which the paper P subjected to the fusing treatment is ejected is positioned on the upper surface of the main body 1*a*.

The paper feed section 2 includes a paper feed cassette 121, a pick-up roller 122, paper feed rollers 123, 124, and 125, and a pair of registration rollers 126. The paper feed cassette 121 is detachably arranged in the main body 1*a* and can store different sized sheets of paper P. The pick-up roller 122 is positioned at the upper left of the paper feed cassette 121 and picks up the paper P sheet by sheet, the paper P being stored in the paper feed cassette 121. The paper feed rollers 123, 124, and 125 feed the paper P picked up by the pick-up roller 122 to a paper conveying path. The pair of registration rollers 126 temporarily holds the paper P fed by the paper feed rollers 123, 124, and 125 to the paper conveying path and then feeds the paper P to the image-forming section 3 at a predetermined timing.

The paper feed section 2 further includes a manual feed tray (not shown) attached to the left side of the main body 1*a* illustrated in FIG. 1; and a pickup roller 127. The pickup roller 127 picks up the paper P placed on the manual feed tray. The paper P picked up by the pickup roller 127 is fed by the paper feed rollers 123 and 125 to the paper conveying path and then fed by the registration roller 126 to the image-forming section 3 at a predetermined timing.

The image-forming section 3 includes an image-forming unit 7, an intermediate transfer belt 31, and a secondary transfer roller 32. A toner image formed based on the image data fed from a computer is primarily transferred onto a surface (contact surface) of the intermediate transfer belt 31 by the image-forming unit 7. The secondary transfer roller 32 secondarily transfers the toner image formed on the intermediate transfer belt 31 onto the paper P fed from the paper feed cassette 121.

The image-forming unit 7 includes a black unit 7K, a yellow unit 7Y, a cyan unit 7C, and a magenta unit 7M sequentially arranged from the upstream side (right side in FIG. 1) in the direction of motion of the intermediate transfer belt 31 to the downstream side. A drum-shaped latent image-bearing member 37, serving as an image-bearing member, is positioned at the center of each of the units 7K, 7Y, 7C, and 7M so as to be rotated in the direction indicated by an arrow (in a clockwise direction). A charging device 39, an exposure device 38, a developing device 71, a cleaning device 8, and a neutralization device (not illustrated) are positioned around each of the latent image-bearing member 37 from the upstream side in the rotational direction thereof.

The charging device 39 uniformly charges the circumferential surface of the latent image-bearing member 37 that rotates in the direction indicated by the arrow. The charging device 39 is not particularly limited as long as it can uniformly charge the circumferential surface of the latent image-bearing member 37. The charging device 39 may be of a non-contact charging type or contact charging type. Specific examples of the charging device include corona charging devices, charging rollers, and charging brushes.

The surface potential (charge potential) of the latent image-bearing member 37 is not particularly limited. The distance between the surface of the conductive base adjacent to the photosensitive layer and the uppermost surface of the latent image-bearing member 37 is 30 μm or less. That is, the photosensitive layer is thin. The latent image-bearing member 37 having a low charging ability and the electrostatic latent image-developing toner of the present disclosure are used in combination. Thus, the latent image-bearing member 37 preferably has a surface potential of +200 V to +500 V and more preferably +200 V to +300 V in view of a balance between developability and charging ability of the latent image-bearing member 37. An excessively low surface potential results in an insufficient development field, thus causing difficulty in ensuring the image density of a formed image. An excessively high surface potential is liable to cause problems, such as the dielectric breakdown of the latent image-bearing member 37 and an increase in the amount of ozone generated.

The latent image-bearing member 37 includes the thin photosensitive layer composed of amorphous silicon on the drum-shaped conductive base. The photosensitive layer composed of amorphous silicon may be formed by a vapor deposition method, e.g., a glow discharge decomposition method, a sputtering method, an electron cyclotron resonance (ECR) method, or an evaporation method. When the photosensitive layer composed of amorphous silicon is formed, hydrogen and a halogen element may be incorporated into the photosensitive layer. To adjust the properties of the photosensitive layer, elements, such as C, N, and O, may be incorporated into the photosensitive layer, and the elements in groups 13 and 15 in the periodic table (long form) may be incorporated into the photosensitive layer.

A material for the photosensitive layer composed of amorphous silicon is not particularly limited as long as the material is amorphous silicon. Preferred examples of an amorphous silicon material include amorphous Si, amorphous SiC, amorphous SiO, and amorphous SiON. Among these amorphous silicon materials, amorphous SiC is more preferred because of its high resistance and excellent charging properties, abrasion resistance, and environmental resistance. In the case where amorphous SiC is used as the amorphous silicon material, amorphous $Si_{(1-X)}C_X$ (wherein X represents 0.3 to 1) is preferred, and amorphous $Si_{(1-X)}C_X$ (wherein X represents 0.5 to 0.95) is more preferred. The amorphous SiC having such a composition has a very high resistance of $10^{12}$ Ω·cm to $10^{13}$ Ω·cm. This inhibits the flow of the latent image charge to provide the latent image-bearing member 37 having an excellent ability to maintain the electrostatic latent image. Furthermore, the use of the amorphous SiC having the composition provides the latent image-bearing member 37 having excellent moisture resistance.

The photosensitive layer may be formed on a carrier blocking layer arranged on the conductive base. Furthermore, a surface protective layer may be arranged on a surface of the photosensitive layer. As the latent image-bearing member 37, a member in which the carrier blocking layer, the photosensitive layer, and the surface protective layer are stacked, in that order, on the conductive base is particularly preferably used.

The arrangement of the surface protective layer inhibits the formation of corona products and an oxide film, which easily adsorbs water molecules, on the surface of the photosensitive layer composed of amorphous silicon during discharge by the charging device 39. Furthermore, the arrangement of the surface protective layer results in improvements in the voltage the latent image-bearing member 37 can withstand and the abrasion resistance of the latent image-bearing member 37 when the latent image-bearing member 37 is repeatedly used. Examples of a material for the surface protective layer include inorganic insulating materials, such as amorphous SiC, amorphous SiO, amorphous SiN, amorphous SiON, and amorphous SiCON.

The thickness of the surface protective layer is not particularly limited. The surface protective layer preferably has a thickness of 20,000 Å or less and more preferably 5,000 Å to 15,000 Å. In the case of the surface protective layer having a thickness within the foregoing range, the latent image-bearing member 37 having withstand voltage performance that is not readily reduced can be produced with high efficiency.

The arrangement of the carrier blocking layer, blocks the injection of carriers into the photosensitive layer composed of amorphous silicon during development. This increases the electrostatic contrast between an exposed portion and a non-exposed portion, thereby improving the image density and reducing the background fog. Examples of a material for the carrier blocking layer include inorganic insulting materials, such as amorphous SiC, amorphous SiO, amorphous SiN, amorphous SiON, and amorphous SiCON; and organic insulating materials, such as polyethylene terephthalate, Parylene (registered trademark), polytetrafluoroethylene, polyimide, polyfluoroethylenepropylene, polyurethane, epoxy resins, polyester, polycarbonate, and cellulose acetate resins.

The thickness of the carrier blocking layer is not particularly limited. The carrier blocking layer preferably has a thickness of 0.01 μm to 5 μm and more preferably 0.1 to 3 μm. In the case of the carrier blocking layer having an excessively small thickness, a desired carrier blocking effect is not easily provided. In the case of the carrier blocking layer having an excessively large thickness, it takes a long time to form the carrier blocking layer, so that the productivity of the latent image-bearing member 37 may be reduced.

The latent image-bearing member 37 is one in which the distance between the surface of the conductive base adjacent to the photosensitive layer and the uppermost surface of the latent image-bearing member 37 is 30 μm or less. This structure of the latent image-bearing member 37 reduces the production cost of the latent image-bearing member 37 and forms a high-resolution image. The "uppermost surface of the latent image-bearing member 37" indicates a surface of the surface protective layer when the surface protective layer is arranged. When the surface protective layer is not arranged, the "uppermost surface of the latent image-bearing member 37" indicates a surface of the photosensitive layer. The "distance between the surface of the conductive base adjacent to the photosensitive layer and the uppermost surface of the latent image-bearing member 37" indicates the total thickness of the carrier blocking layer, the photosensitive layer, and the surface protective layer.

For the latent image-bearing member 37, the lower limit of the distance between the surface of the conductive base adjacent to the photosensitive layer and the uppermost surface of the latent image-bearing member 37 is not particularly limited. The lower limit is preferably 10 μm or more. In the case of an excessively short distance, the latent image-bearing member 37 may have insufficient charging performance. Furthermore, when a formed image has a gray-scale pattern, interference fringes due to the diffused reflection of laser light used for exposure may be caused in the gray-scale pattern.

The exposure device 38 is known as a laser scanning device. The exposure device 38 irradiates the circumferential surface of the latent image-bearing member 37 uniformly charged by the charging device 39 with laser light based on the image data fed from a personal computer (PC), which is a higher-level device, to form an electrostatic latent image on the latent image-bearing member 37 based on the image data. The developing device 71 feeds the electrostatic latent image-developing toner of the present disclosure to the circumferential surface, on which the electrostatic latent image is formed, of the latent image-bearing member 37 to form a toner image on the circumferential surface of the latent image-bearing member 37 based on the image data. The structure of the developing device 71 may be appropriately changed, depending on the type of developer and a developing method. The toner image formed on the circumferential surface of the latent image-bearing member 37 by the developing device 71 is primarily transferred to the intermediate transfer belt 31.

After completion of the primary transfer of the toner image to the intermediate transfer belt 31, the toner left on the circumferential surface of the latent image-bearing member 37 is removed by the cleaning device 8. The cleaning device 8 includes an elastic blade 81 that removes the toner left on the circumferential surface of the latent image-bearing member 37. In the method for forming an image according to the present embodiment, when the toner according to the previous embodiment is used, the circumferential surface of the latent image-bearing member 37 is satisfactorily polished by removing the toner left on the circumferential surface of the latent image-bearing member 37, thus efficiently removing corona products formed during charging. This inhibits an image flow that is easily caused in a high-temperature and high-humidity environment. In this case, even if the image-forming apparatus includes the cleaning device 8 having the elastic blade 81, dielectric breakdown is prevented on the surface of the latent image-bearing member 37 near an end of the elastic blade 81, the latent image-bearing member 37 including the thin photosensitive layer composed of amorphous silicon.

The elastic blade is composed of a urethane sponge or ethylene-propylene rubber.

The neutralization device eliminates the charge on the circumferential surface of the latent image-bearing member 37 after completion of the primary transfer. The circumferential surface of the latent image-bearing member 37 that has been cleaned by the cleaning device 8 and the neutralization device moves to the charging device 39 for another charging treatment. Then the latent image-bearing member 37 is subjected to another charging treatment.

The intermediate transfer belt 31 is an endless belt-shaped rotary member. The intermediate transfer belt 31 is stretched over plural rollers, such as a driving roller 33, a driven roller 34, a backup roller 35, and primary transfer rollers 36, in such a manner that a surface (contact surface) of the intermediate transfer belt 31 is in contact with the circumferential surface of each of the latent image-bearing members 37. The intermediate transfer belt 31 is configured to run endlessly over the plural rollers while the intermediate transfer belt 31 is pressed against the latent image-bearing members 37 by the primary transfer rollers 36 that face the respective latent image-bearing members 37. The driving roller 33 is rotationally driven by a driving source (not illustrated), such as a stepping motor, and provides the driving force to allow the intermediate transfer belt 31 to run endlessly. The driven roller 34, the backup roller 35, and the primary transfer rollers 36 are rotatably positioned and are rotationally driven by the driving roller 33 via the endless run of the intermediate transfer belt 31. These rollers 34, 35, and 36 are rotationally driven by the rotation of the driving roller 33 via the intermediate transfer belt 31 and support the intermediate transfer belt 31.

The primary transfer rollers 36 apply primary transfer biases (a polarity opposite to a charge polarity of toners) to the intermediate transfer belt 31. Thus, the toner images formed on the latent image-bearing members 37 are sequentially transferred (primarily transferred) to the intermediate transfer belt 31 in a superposition manner at positions between the latent image-bearing members 37 and the respective primary transfer rollers 36, while the intermediate transfer belt 31 running in the direction indicated by the arrow (counterclockwise) by the driving of the driving roller 33.

The secondary transfer roller 32 applies a secondary transfer bias, which has a polarity opposite to that of the toner image, to the sheet P. The toner image primarily transferred to the intermediate transfer belt 31 is secondarily transferred to the sheet P at a position between the secondary transfer roller 32 and the backup roller 35, thereby transferring a color transfer image (unfixed toner image) on the paper P.

In the fixing section 4, the image transferred to the paper P in the image-forming section 3 is subjected to fixing treatment. The fixing section 4 includes a heating roller 41 heated by an electric heating member and a pressing roller 42. The pressing roller 42 faces the heating roller 41 and has a circumferential surface that is pressed against a circumferential surface of the heating roller 41.

The image transferred to the paper P by the secondary transfer roller 32 in the image-forming section 3 is subjected to fixing treatment by heating and pressing when the paper P is passed between the heating roller 41 and the pressing roller 42, thereby fixing the transfer image on the paper P. The paper P subjected to fixing treatment is ejected to the paper-ejecting section 5. In the color printer 1 according to the present embodiment, a plurality of pairs of conveying rollers 6 are appropriately arranged between the fixing unit 4 and the paper-ejecting section 5.

The paper-ejecting section 5 is a recessed section located on the top of the main body 1*a* of the color printer 1. A paper output tray 51 configured to receive the ejected paper P is arranged on the bottom of the recessed section.

The color printer 1 forms an image on the paper P by the foregoing image-forming operations. The color printer 1 includes the cleaning device 8 having the elastic blade 81; and the latent image-bearing member 37 having the thin photosensitive layer composed of amorphous silicon on the conductive base. Thus, in the situation when an image is formed with the foregoing tandem-type color image-forming apparatus (the color printer 1), which is liable to lead to the dielectric breakdown of the photosensitive layer and an image flow under a high-temperature and high-humidity environment, the development with the electrostatic latent image-developing toner according to the previous embodiment results in the suppression of the occurrence of the image flow and the dielectric breakdown. Furthermore, in the situation when an image is formed with the image-forming apparatus having the foregoing structure, the use of the toner according to the previous embodiment results in a satisfactory image without reducing the image density to a value less than a desired value for a prolonged period.

EXAMPLES

While the present disclosure will be described in detail below by examples, the present disclosure is not limited to these examples.

A polyester resin used as a binder resin in Examples and Comparative Examples was produced as described below.

Production Example of Polyester Resin

Into a reaction vessel, 1960 g of a propylene oxide adduct of bisphenol A, 780 g of an ethylene oxide adduct of bisphenol A, 257 g of dodecenylsuccinic anhydride, 770 g of terephthalic acid, and 4 g of dibutyltin oxide were charged. The temperature in the reaction vessel was increased to 235° C. under a nitrogen atmosphere. A reaction was performed at 235° C. for 8 hours. Then the pressure in the reaction vessel was reduced to 8.3 kPa. The reaction was performed at the temperature for 1 hour to give a reaction product. The resulting reaction product was cooled to 180° C. Trimellitic anhydride was added thereto in such a manner that the polyester resin had an acid value of about 10 mgKOH/g. Then the mixture was heated to 210° C. at a rate of temperature increase of 10° C./hour. A reaction was performed at 210° C. to give a polyester resin.

Example 1

Preparation of Toner Base Particles

First, 87 parts by mass of the polyester resin produced according to Production Example of Polyester Resin, 5 parts by mass of a release agent (ester wax WEP-3, manufactured by NOF Corporation), 3 parts by mass of a positively chargeable charge control agent (BONTRON P-51 (quaternary ammonium salt, manufactured by Orient Chemical Industries Co., Ltd.), and 5 parts by mass of carbon black (MA-100, manufactured by Mitsubishi Chemical Corporation) were mixed together using a Henschel mixer. The resulting mixture was melt-kneaded with a twin-screw extruder, cooled, and roughly pulverized with a hammer mill. The roughly pulverized powder was finely pulverized with a mechanical pulverizer and then classified with an air classifier to provide toner base particles having a volume-average particle diameter of 7.0 μm.

Preparation of Titanium Oxide

A titanium tetrachloride solution was neutralized with sodium hydroxide to deposit a colloidal titanium compound. After aging, the colloidal titanium compound was fired at 575° C. The fired titanium compound was pulverized with a hammer mill to provide titanium oxide. In this case, different pulverizing conditions with the hammer mill were used to provide various titanium oxide particles having different average particle diameters of 0.05 μm to 0.50 μm.

The resulting titanium oxide particles were dispersed in water. Sodium pyrophosphate was added thereto. Resulting mixtures was wet-pulverized with a sand mill to provide a water-soluble slurry having a titanium oxide concentration of 50 g/L. The slurry was heated to 80° C. A 10% sodium hydroxide solution and a solution of appropriate amounts of tin chloride ($SnCl_4.5H_2O$) and antimony chloride ($SbCl_3$) dissolved in 300 cc of a 2 N hydrochloric acid solution were added to the slurry containing titanium oxide dispersed therein over a period of 60 minutes while the pH was maintained at 6 to 9. This resulted in the formation of a coating layer composed of tin oxide and antimony oxide on the surface of each of the titanium oxide particles. The pH of the slurry containing titanium oxide dispersed therein was ultimately adjusted to 8. Filtration and washing were repeatedly performed until the resistivity of the filtrate reached 20,000 Ω·cm, thereby providing a wet cake of titanium oxide. The resulting wet cake was dried at 120° C. The dried titanium oxide was fired for 60 minutes in an electric furnace set at 500° C. The resulting fired product was disaggregated with a jet mill to provide titanium oxide. The amounts of tin chloride and antimony chloride, the particle diameter of titanium oxide treated with tin chloride and antimony chloride, and disaggregation conditions with the jet mill were appropriately changed to provide the titanium oxide A and the titanium oxide B having average primary particle diameters and volume resistivities described in Tables 1 and 2.

The volume resistivity of each of the titanium oxide A and the titanium oxide B was measured by applying a voltage of 10 V DC to a sample under a load of 1 kg with a high resistance meter (model: R8340A, manufactured by Advantest Corporation).

Preparation of Toner

The toner base particles, 1.0% by mass of the titanium oxide A having an average primary particle diameter of 120 nm, 1.0% by mass of the titanium oxide B having an average primary particle diameter of 280 nm, and 2.0% by mass of silica (RA-200H, manufactured by Nippon Aerosil Co., Ltd.), with respect to the mass of the toner base particles, were mixed together using a Henschel mixer (FM-20B, manufactured by Nippon Coke & Engineering Co., Ltd.) at a peripheral speed of an impeller of 35 m/sec, a mixing time of 15 minutes, and a jacket cooling water temperature of 20° C., thereby attaching titanium oxide and silica to surfaces of the toner base particles to provide a toner. The liberation rate of titanium oxide in the resulting toner was measured according to a method described below. The liberation rate of titanium oxide in the toner in Example 1 is illustrated in Table 1.

Liberation Rate of Titanium Oxide

Free titanium oxide of the titanium oxide A and the titanium oxide B was separated from the toner with an air classifier (DSX-2, manufactured by Nippon Pneumatic Mfg. Co., Ltd.) under conditions described below.

Separation Conditions of Titanium Oxide

Sample feed rate: 100 g/min

Injection pressure at feed section: 0.2 MPa

Adjusting ring: 80 mm

Louver height: 10 mm

Louver clearance: 5 mm

Distance ring: 0 mm

Center navel: 60 mm

U damper: 45°

Cyclone damper: 30°

Total static pressure of blower: −800 mmAq (−7.85 kPa)

With respect to the free titanium oxide separated from the toner containing free titanium oxide A and free titanium oxide B, the particle diameter, the number of particles, and the average volume were measured with a laser diffraction-type measuring device (LA-950, manufactured by HORIBA, Ltd). The resulting number distribution (particle diameter distribution) curve of the free titanium oxide for each particle diameter was analyzed with waveform analysis software (Origin 8.5, manufactured by Lightstone Corp). Thereby, the particle diameter distribution curve of the free titanium oxide was separated into a particle diameter distribution curve of the free titanium oxide originating from the titanium oxide A and a particle diameter distribution curve of the free titanium oxide originating from the titanium oxide B. The number of particles and the average volume of each of the free titanium oxide originating from the titanium oxide A and the free titanium oxide originating from the titanium oxide B were determined based on the separated two particle diameter distribution curves.

The resulting liberation rate of the titanium oxide A or the titanium oxide B was calculated from an expression described below with the number of particles and the average volume of the free titanium oxide originating from the titanium oxide A or the titanium oxide B and the amount of the titanium oxide A or the titanium oxide B in the toner.

The amounts of the titanium oxide A and the titanium oxide B in the toner were calculated based on the amounts of the titanium oxide A and the titanium oxide B used for the preparation of the toner.

Calculation Formula for Liberation Rate of Titanium Oxide ((Average volume of free titanium oxide ($cm^3$)×number of particles of free titanium oxide×density of titanium oxide ($g/cm^3$))/amount of titanium oxide in toner (g))×100

Preparation of Two-Component Developer

A carrier (used for color printer FS-05400DN, manufactured by KYOCERA MITA Corporation) and 8% by mass of the toner with respect to the mass of the carrier were mixed together using a ball mill for 30 minutes to prepare a two-component developer. The charge amount of the toner, the image density, and the occurrence of an image flow in Example 1 were evaluated according to a method described below with the resulting two-component developer. The evaluation results of the charge amount of the toner, the image density, and the occurrence of the image flow in Example 1 are described in Table 1.

Charge Amount

The charge amount was evaluated with a page printer (FS-05400DN, manufactured by KYOCERA MITA Corporation) including a latent image-bearing member which had an amorphous silicon photosensitive layer and in which the distance between a surface of a conductive base adjacent to the photosensitive layer and the uppermost surface of the latent image-bearing member was 14 μm, and a cleaning device having an elastic blade. The two-component developer produced in Example 1 was charged into a developing unit for black. The toner produced in Example 1 was charged into a toner container for black. The initial charge amount of the toner was measured under a room-temperature and normal-humidity environment (20° C. and 65% RH). Then 100,000 copies were made by continuous printing with the page printer (FS-05400DN) at a coverage rate of 0.1% under the room-temperature and normal-humidity environment (20° C. and 65% RH). After the continuous printing, the charge amount of the toner was measured. The measurement of the charge amount was performed with a charge measurement system (Q/M Meter 210HS, manufactured by TREK, INC).

Image Density

An image evaluation pattern was formed by printing with the page printer (FS-05400DN) under a room-temperature and normal-humidity environment (20° C. and 65% RH) to provide an initial image. After 100,000 copies were made by continuous printing at a coverage rate of 0.1% under the room-temperature and normal-humidity environment (20° C. and 65% RH), an image evaluation pattern was formed by printing. The image density of each of the solid image of the initial image and of the image evaluation pattern formed after the printing of 100,000 copies was measured with a reflection densitometer (RD914, manufactured by Gretag-Macbeth AG). In the following criteria, "A" was rated as acceptable, and "B" and "C" were rated as unacceptable.

A: An image density of 1.22 or more.

B: An image density of 1.20 or more and less than 1.22.

C: An image density of less than 1.20.

Image Flow

Under the room-temperature and normal-humidity environment (20° C. and 65% RH), 5,000 copies were made by continuous printing with the page printer (FS-05400DN) at a coverage rate of 5%. Next, the page printer was allowed to stand for a whole day and night under a high-temperature and high-humidity environment (33° C. and 85% RH). Then an image evaluation pattern was formed by printing with the page printer. The occurrence of an image flow was visually checked. The evaluation criteria of the image flow are described below. "A" was rated as acceptable, and "B" and "C" were rated as unacceptable.

A: No image flow is observed.

B: A slight image flow is observed.

C: A significant image flow is observed.

State of Dielectric Breakdown of Latent Image-Bearing Member (Occurrence of Black Spot)

Under a room-temperature and normal-humidity environment (20° C. and 65% RH), 100,000 copies were made by continuous printing with the page printer (FS-05400DN) at a coverage rate of 5%. Then a blank image (A4-size paper) was outputted. The number of black spots due to the dielectric breakdown of the latent image-bearing member was measured with a dot analyzer (DA-5000S, manufactured by Oji Scientific Instruments). The black spots were measured in a 5 mm×210 mm region in the transverse direction of the A4-size paper. The evaluation criteria of the state of dielectric breakdown of the latent image-bearing member (black spots) were described below. "A" was rated as acceptable, and "B" was rated as unacceptable.

A: No black spot is formed.

B: one or more black spots are formed.

Examples 2 to 10 and Comparative Examples 1 to 10

Toner Base particles, toners, and two-component developers were prepared as in Example 1, except that the titanium oxide A and the titanium oxide B having different primary particle diameters and different volume resistivities as described in Tables 1 and 2 were used and that different external addition conditions as described in Tables 1 and 2 were used. With respect to the toners in Examples 2 to 10 and Comparative Examples 1 to 10, the liberation rates of the titanium oxide A and the titanium oxide B were measured as in Example 1. The liberation rates of the titanium oxide A and the titanium oxide B in Examples 2 to 10 and Comparative Examples 1 to 10 were described in Tables 1 and 2.

The charge amount, the image density, the occurrence of an image flow, and the occurrence of black spots, of each of the toners in Examples 2 to 10 and Comparative Examples 1 to 10, were evaluated as in Example 1 with the two-component developers containing the toners in Examples 2 to 10 and Comparative Examples 1 to 10. The evaluation results of the toners and the two-component developers in Examples 2 to 10 and Comparative Examples 1 to 10 are described in Tables 1 and 2. In Comparative Example 5, a flaw was observed on the surface of the latent image-bearing member after the test of continuously printing 100,000 copies.

TABLE 1

| | Examples | | | | | | | | | |
|---|---|---|---|---|---|---|---|---|---|---|
| | 1 | 2 | 3 | 4 | 5 | 6 | 7 | 8 | 9 | 10 |
| Titanium Oxide A | | | | | | | | | | |
| Primary Particle Diameter (nm) | 120 | 120 | 170 | 50 | 170 | 50 | 120 | 120 | 120 | 120 |
| Volume Resistivity (Ω · cm) | $7 \times 10^4$ | $7 \times 10^4$ | $7 \times 10^4$ | $6 \times 10^4$ | $6 \times 10^4$ | $6 \times 10^4$ | $1 \times 10^1$ | $3 \times 10^7$ | $7 \times 10^4$ | $7 \times 10^4$ |
| Liberation Rate (% by mass) | 30 | 25 | 38 | 12 | 40 | 15 | 31 | 47 | 39 | 38 |
| Titanium Oxide B | | | | | | | | | | |
| Primary Particle Diameter (nm) | 280 | 280 | 500 | 200 | 200 | 500 | 280 | 280 | 280 | 280 |
| Volume Resistivity (Ω · cm) | $8 \times 10^{10}$ | $8 \times 10^{10}$ | $6 \times 10^{10}$ | $7 \times 10^{10}$ | $7 \times 10^{10}$ | $6 \times 10^{10}$ | $8 \times 10^{10}$ | $8 \times 10^{10}$ | $1 \times 10^7$ | $4 \times 10^{15}$ |
| Liberation Rate (% by mass) | 80 | 75 | 91 | 52 | 60 | 93 | 88 | 85 | 90 | 82 |
| External Addition Condition | | | | | | | | | | |
| Peripheral Speed of Impeller (m/second) | 35 | 40 | 35 | 35 | 35 | 35 | 35 | 35 | 35 | 35 |
| Mixing Time (minute) | 15 | 15 | 15 | 15 | 15 | 15 | 15 | 15 | 15 | 15 |
| Charge Amount | | | | | | | | | | |
| Initial (μC/g) | 21.1 | 22.0 | 23.9 | 22.4 | 24.3 | 22.8 | 20.4 | 23.8 | 22.4 | 24.8 |
| After 100,000 copies (μC/g) | 21.7 | 22.3 | 22.8 | 21.9 | 23.3 | 22.7 | 21.4 | 23.4 | 22.8 | 24.4 |
| Image Density | | | | | | | | | | |
| Initial | 1.40 | 1.37 | 1.33 | 1.41 | 1.40 | 1.39 | 1.38 | 1.37 | 1.36 | 1.35 |
| After 100,000 copies | 1.35 | 1.36 | 1.29 | 1.31 | 1.30 | 1.33 | 1.35 | 1.33 | 1.30 | 1.29 |
| Evaluation | A | A | A | A | A | A | A | A | A | A |
| Image Flow | A | A | A | A | A | A | A | A | A | A |
| Black Spot | A | A | A | A | A | A | A | A | A | A |

TABLE 2

| | Comparative Examples | | | | | | | | | |
|---|---|---|---|---|---|---|---|---|---|---|
| | 1 | 2 | 3 | 4 | 5 | 6 | 7 | 8 | 9 | 10 |
| Titanium Oxide A | | | | | | | | | | |
| Primary Particle Diameter (nm) | 120 | 120 | 120 | 190 | 120 | 120 | 120 | 120 | 120 | 120 |
| Volume Resistivity (Ω · cm) | $7 \times 10^4$ | $7 \times 10^4$ | $7 \times 10^4$ | $8 \times 10^4$ | $7 \times 10^4$ | $7 \times 10^4$ | 0.5 | $2 \times 10^8$ | $7 \times 10^4$ | $7 \times 10^4$ |
| Liberation Rate (% by mass) | 55 | 53 | 20 | 48 | 51 | 43 | 38 | 48 | 40 | 37 |
| Titanium Oxide B | | | | | | | | | | |
| Primary Particle Diameter (nm) | 280 | 280 | 500 | 200 | 520 | 190 | 280 | 280 | 280 | 280 |
| Volume Resistivity (Ω · cm) | $7 \times 10^{10}$ | $8 \times 10^{10}$ | $6 \times 10^{10}$ | $7 \times 10^{10}$ | $7 \times 10^{10}$ | $6 \times 10^{10}$ | $8 \times 10^{10}$ | $8 \times 10^{10}$ | $1 \times 10^7$ | $4 \times 10^{15}$ |
| Liberation Rate (% by mass) | 80 | 89 | 48 | 92 | 94 | 45 | 79 | 84 | 77 | 83 |
| External Addition Condition | | | | | | | | | | |
| Peripheral Speed of Impeller (m/second) | 30 | 30 | 40 | 35 | 35 | 35 | 35 | 35 | 35 | 35 |
| Mixing Time (minute) | 10 | 15 | 20 | 15 | 15 | 15 | 15 | 15 | 15 | 15 |
| Charge Amount | | | | | | | | | | |
| Initial (μC/g) | 21.9 | 22.3 | 23.8 | 21.8 | 23.9 | 26.4 | 21.4 | 24.5 | 20.5 | 26.5 |
| After 100,000 copies (μC/g) | 27.4 | 25.3 | 21.1 | 25.5 | 22.8 | 25.5 | 22.0 | 25.8 | 21.8 | 25.8 |

TABLE 2-continued

| | Comparative Examples | | | | | | | | | |
|---|---|---|---|---|---|---|---|---|---|---|
| | 1 | 2 | 3 | 4 | 5 | 6 | 7 | 8 | 9 | 10 |
| Image Density | | | | | | | | | | |
| Initial | 1.35 | 1.30 | 1.31 | 1.32 | 1.35 | 1.31 | 1.21 | 1.33 | 1.22 | 1.27 |
| After 100,000 copies | 1.19 | 1.21 | 1.26 | 1.21 | 1.20 | 1.22 | 1.18 | 1.18 | 1.20 | 1.16 |
| Evaluation | C | B | A | B | B | A | C | C | B | C |
| Image Flow | A | A | B | A | A | C | A | A | A | A |
| Black Spot | A | A | A | A | A | A | A | B | A | B |

For example, a comparison of Example 1 with Example 2 demonstrates that an increase in the peripheral speed of the impeller results in a reduction in the liberation rate of titanium oxide. With respect to the liberation rate of the titanium oxide A, a comparison of Example 2 with Comparative Example 3 demonstrates that a longer stirring time at the time of the external addition results in a reduction in the liberation rate of titanium oxide.

As is apparent from Table 1, in Examples 1 to 10, each of the toners contains the titanium oxide A and the titanium oxide B. The titanium oxide A has an average primary particle diameter of 50 nm to 180 nm and a volume resistivity of $1\times10^{1}$ Ω·cm to $1\times10^{7}$ ∩·cm and the titanium oxide B has an average primary particle diameter of 200 nm to 500 nm and a volume resistivity of $1\times10^{7}$ Ω·m to $1\times10^{15}$ Ω·cm. The liberation rate of the titanium oxide A is 50% by mass or less and the liberation rate of the titanium oxide B is greater than 50% by mass. The results demonstrate that by using each toner, it is possible to form the images each having a satisfactory image density before and after the continuous printing of 100,000 copies, no image flow occurs even under the high-temperature and high-humidity environment, and the dielectric breakdown of the latent image-bearing member does not occur.

As is apparent from Table 2, in Comparative Examples 1, 2, and 5, the images are formed with the toners each having a liberation rate of the titanium oxide A that is greater than 50% by mass. The results demonstrate that for each toner, the image density is less than a desired value after the continuous printing of 100,000 copies. In each of Comparative Examples 3 and 6, the images are formed with the toners each having a liberation rate of the titanium oxide B of 50% by mass or less. The results demonstrate that for each toner, the image flow is liable to occur under the high-temperature and high-humidity environment because the surface of the latent image-bearing member is not satisfactorily polished.

In Comparative Example 4, the images are formed with the toner having a liberation rate of the titanium oxide A of 50% by mass or less, a liberation rate of the titanium oxide B that is greater than 50% by mass, and an average primary particle diameter of the titanium oxide A that is greater than 180 nm. The results demonstrate that the image density is less than a desired value after the continuous printing of 100,000 copies. In Comparative Example 5, the images are formed with the toner having an average primary particle diameter of the titanium oxide B that is greater than 500 nm. The results demonstrate that the image density is less than a desired value after the continuous printing of 100,000 copies. Furthermore, the abrasion of the latent image-bearing member reduces the service life of the latent image-bearing member. In Comparative Example 6, the images are formed with the toner having an average primary particle diameter of the titanium oxide B of less than 200 nm. The results demonstrate that the image flow is liable to occur under the high-temperature and high-humidity environment.

In the toner of each of Comparative Examples 7 to 10, the titanium oxide A has an average primary particle diameter of 50 nm to 180 nm and a liberation rate of 50% by mass or less, and the titanium oxide B has an average primary particle diameter of 200 nm to 500 nm and a liberation rate that is greater than 50% by mass. However, the volume resistivity of the titanium oxide A is outside the range of $1\times10^{1}$ Ω·cm to $1\times10^{7}$ Ω·cm, or the volume resistivity of the titanium oxide B is outside the range of $1\times10^{7}$ Ω·cm to $1\times10^{15}$ Ω·cm. The images are formed with the toner. The results demonstrate that although the image flow is inhibited under the high-temperature and high-humidity environment, the image density is less than a desired value after the continuous printing of 100,000 copies.

In particular, in Comparative Examples 8 and 10, the images are formed with the toners each having a volume resistivity of the titanium oxide A that is greater than $1\times10^{7}$ Ω·cm and a volume resistivity of the titanium oxide B that is greater than $1\times10^{15}$ Ω·cm. The results demonstrate that an excessively large charge amount of the toner at the contact portion between the surface of the latent image-bearing member and the elastic blade causes the dielectric breakdown of the latent image-bearing member, so that an image defect, such as a black spot, occurs easily.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. An electrostatic latent image-developing toner, comprising:

toner base particles comprising a binder resin, a colorant, and a charge control agent; and an external additive attached to surfaces of the toner base particles, wherein the external additive contains titanium oxide, the titanium oxide comprises titanium oxide A, and titanium oxide B, each of the titanium oxide A and the titanium oxide B has a coating layer composed of tin oxide and antimony oxide on a surface thereof, the titanium oxide A has an average primary particle diameter of 50 nm to 180 nm and a volume resistivity of $1\times10^{1}$ Ω·cm to $1\times10^{7}$ Ω·cm, and the titanium oxide B has an average primary particle diameter of 200 nm to 500 nm and a volume resistivity of $1\times10^{7}$ Ω·cm to $1\times10^{15}$ Ω·cm, and wherein when the liberation rate of the titanium oxide in the electrostatic latent image-developing toner is measured by a classification of free titanium oxide in the electrostatic latent image-developing toner with an air classifier, the liberation rate of the titanium oxide A is 50% by mass or less, and the liberation rate of the titanium oxide B is greater than 50% by mass.

2. The electrostatic latent image-developing toner according to claim 1, wherein the titanium oxide content is in the range of 0.5% to 5% by mass with respect to the mass of the electrostatic latent image-developing toner.

3. The electrostatic latent image-developing toner according to claim 2, wherein the titanium oxide A content is 0.1% to 3% by mass with respect to the mass of the electrostatic latent image-developing toner, and wherein the titanium oxide B content is 0.1% to 3% by mass with respect to the mass of the electrostatic latent image-developing toner.

4. A method for forming an image with an image-forming apparatus, wherein the image-forming apparatus includes a latent image-bearing member, and a cleaning device having an elastic blade, the latent image-bearing member including a thin photosensitive layer composed of amorphous silicon on a conductive base, and the distance between a surface of the conductive base adjacent to the photosensitive layer and the uppermost surface of the latent image-bearing member being 30 μm or less, comprising the steps of using as a toner to form the image an electrostatic latent image-developing toner that includes toner base particles comprising a binder resin, a colorant, and a charge control agent; and an external additive attached to the toner base particles, wherein the external additive contains titanium oxide, the titanium oxide comprises titanium oxide A, and titanium oxide B, each of the titanium oxide A and the titanium oxide B has a coating layer composed of tin oxide and antimony oxide on a surface thereof, the titanium oxide A has an average primary particle diameter of 50 nm to 180 nm and a volume resistivity of $1\times10^{1}$ Ω·cm to $1\times10^{7}$ Ω·cm, and the titanium oxide B has an average primary particle diameter of 200 nm to 500 nm and a volume resistivity of $1\times10^{7}$ Ω·cm to $1\times10^{15}$ Ω·cm, and wherein when the liberation rate of the titanium oxide in the electrostatic latent image-developing toner is measured by a classification of free titanium oxide in the electrostatic latent image-developing toner with an air classifier, the liberation rate of the titanium oxide A is 50% by mass or less, and the liberation rate of the titanium oxide B is greater than 50% by mass, and forming the image in the apparatus.

5. The method according to claim 4, wherein the titanium oxide content is 0.5% to 5% by mass with respect to the mass of the electrostatic latent image-developing toner.

6. The method according to claim 5, wherein the titanium oxide A content is 0.1% to 3% by mass with respect to the mass of the electrostatic latent image-developing toner, and wherein the titanium oxide B content is 0.1% to 3% by mass with respect to the mass of the electrostatic latent image-developing toner.

* * * * *